US005854442A

United States Patent [19]

Scheffee et al.

[11] Patent Number: 5,854,442

[45] Date of Patent: Dec. 29, 1998

[54] GAS GENERATOR COMPOSITIONS

[75] Inventors: Robert S. Scheffee, Lorton; Brian K. Wheatley, Marshall, both of Va.

[73] Assignee: Atlantic Research Corporation, Wilmington, Del.

[21] Appl. No.: 708,195

[22] Filed: Sep. 6, 1996

Related U.S. Application Data

[63] Continuation-in-part of Ser. No. 663,010, Jun. 7, 1996, which is a continuation-in-part of Ser. No. 663,012, Jun. 7, 1996, which is a continuation-in-part of Ser. No. 508,350, Jul. 28, 1995, which is a continuation-in-part of Ser. No. 414,470, Mar. 31, 1995.

[51] Int. Cl.[6] ..... C06B 45/06

[52] U.S. Cl. ..... 149/18; 149/19.4; 149/92; 252/373

[58] Field of Search ..... 252/373; 149/18, 149/92, 19.4

[56] References Cited

U.S. PATENT DOCUMENTS

| | | | |
|---|---|---|---|
| 3,613,597 | 10/1971 | Warren . | |
| 3,739,574 | 6/1973 | Godfrey . | |
| 3,845,970 | 11/1974 | Herrmann . | |
| 3,954,528 | 5/1976 | Chang et al. . | |
| 4,111,728 | 9/1978 | Ramnarace . | |
| 5,125,684 | 6/1992 | Cartwright . | |
| 5,336,439 | 8/1994 | Forsberg et al. . | |
| 5,351,619 | 10/1994 | Chan et al. . | |
| 5,538,567 | 7/1996 | Henry III | 149/18 |

OTHER PUBLICATIONS

Barton et al;Pap.Jt.Symp.Compat.Plast./Mater.Explos.Process.Explos.,311–23 1980.

*Primary Examiner*—Gary Geist
*Assistant Examiner*—Sreeni Padmanabhan
*Attorney, Agent, or Firm*—Lowe, Price, LeBlanc & Becker

[57] ABSTRACT

A composition for generating a non-toxic, non-flammable, odorless gas is disclosed wherein the propellant of said composition is a mixture of about 30% by weight to about 45% by weight $KClO_4$ with about 55% by weight to 706 by weight of guanidine nitrate or a gas-generative effective derivative thereof with about 1% by weight to 3% by weight cellulose acetate butyrate, the oxidation ratio of oxidizer to fuel being about 0.92 to about 0.98. The method of using said composition is also disclosed.

24 Claims, 2 Drawing Sheets

GAS GENERATOR COMPOSITIONS

This application is a continuation-in-part of U.S. Ser. No. 08/663,010 filed Jun. 7, 1996, which is a continuation-in-part of U.S. Ser. No. 08/663,012 filed Jun. 7, 1996, which is a continuation-in-part of U.S. Ser. No. 08/508,350 filed Jul. 28, 1995, which is a continuation-in-part of U.S. Ser. No. 08/414,470 Filed Mar. 31, 1995.

FIELD OF THE INVENTION

This invention involves a composition for generating a low particulate non-toxic, non-flammable, odorless and colorless gas. Said composition comprises a propellant mixture of an alkali perchlorate and guanidine nitrate, or an effective gas generative derivative thereof, with a minor amount of a cellulose acetate butyrate combustion modifier. The composition finds particular use in generating gas to inflate an air bag in an occupant restraint in an automobile.

PRIOR ART

The substance of the present invention involves solid composite propellant compositions and their use as gas generators.

There is a continuing market for new compositions to generate, in a high volume, a gas that is non-toxic, cool burning, non-flammable and contains only a low concentration of solid particulates, said gas to be employed with air bags. Although some modification of earlier devices has resulted in increased production of cooler gases, such modifications have contributed to the formation of undesirable byproducts and created a variety of problems. Accordingly, neither known materials nor newly modified materials are recognized as both increasing the evolution of and lowering the temperature of generated gases and being essentially problem-free for the instant use.

Many patents disclose lists of oxidizers that include alkali and alkaline earth perchlorates and lists of materials that may be employed to serve as a fuel to be oxidized and thereby generate a gas. However, the prior art does not disclose the present composition and its outstanding properties in generating gas.

Exemplary of the prior art disclosures, U.S. Pat. No. 4,948,439, at col. 5, refers to a mixture of ammonium perchlorate and sodium tetrazole in an equimolar ratio as an especially useful composition. Useful oxidizing compounds are described as salts, such as the ammonium, alkali metal and alkaline earth metal nitrates and perchlorates. The patentee cautions that ammonium perchlorate, although a good oxidizer, is not useful as the sole oxidizer since it will produce hydrogen chloride or other toxic products if not balanced by the presence of a metal salt, such as the nitrate of sodium or potassium. Insofar as the reference advances the use of perchlorates, these are described merely as recognized oxidizers.

In U.S. Pat. No. 5,482,579, the patentee refers to a prior art composition as comprising three components, an oxidizing agent, a cellulose acetate and a carbon-containing combustion controller. The composition is said to contain 78% to 92% by weight of a chlorate or perchlorate of an alkali metal or alkaline earth metal as the oxidizing agent, 7.9 to 17.2% by weight of a cellulose acetate and 0.1 to 0.8% by weight of a carbon-containing combustion controller, i.e., acetylene black or graphite.

Cellulose acetate in said '579 patent is described as a combustible material consisting of carbon, hydrogen and oxygen. The patentee notes that when cellulose acetate is mixed with a powder, such as an oxidizing agent, the cellulose acetate interposes the gaps between the powder particles and thus acts as a binder. It is incorporated in the composition in the range of 8 to 26% by weight. At col. 4, beginning at line 20, the patentee identifies a nitrogen-containing non-metallic compound to control the combustion temperature as one selected from the group consisting of guanidine compounds, oximes, amides, tetrazole derivatives, aromatic nitro compounds and ammonium nitrate. Guanidine nitrate is specifically mentioned. In column 3, the weight percent of potassium perchlorate is set forth as in the range of 45% to about 87%. Both the described patents relate to generating a gas to inflate a "crash" bag.

On the other hand, U.S. Pat. No. 3,909,324 discloses as the principal object of the invention therein the provision of a novel pyrotechnic composition for disseminating smoke dyes, pesticides, chemical warfare and similar agents. The compositions contain amino-guanidinium nitrate or condensation products thereof, as a fuel, and inorganic oxidizers which are readily combustible at atmospheric pressure. In claim 1 of the patent, a pyrotechnic disseminating formulation is recited comprising about 8 to about 40 weight percent of aminoguanidinium nitrate or condensation products thereof and 8 to about 30 weight percent of an alkali metal or ammonium chlorate or perchlorate as oxidizer, the balance being an effective amount of a chemical warfare agent, an incapacitating agent, a smoke dye or a plant growth regulant to be disseminated.

The subject matter of U.S. Pat. No. 4,543,136 concerns a water-in-oil emulsion explosive composition. The composition includes an inorganic oxidizer salt which may be, for example, one of various nitrates, chlorates or perchlorates, including alkali metal or alkaline earth metal perchlorates. The inorganic oxidizer salts are used alone or in admixture of at least two members. The oxidizer salt is generally present in 5 to 90 percent, preferably 40 to 85 percent and is used in the form of an aqueous solution. At col. 5, beginning at line 17, the patentee discusses sensitizers effective for improving the detonation liability and low temperature detonability of the resulting water-in-oil explosive. Among the various substances listed is guanidine nitrate. The compounding amount of the sensitizer is said to be 0 to 40 percent, preferably 0.5 to 30 percent.

Recently issued U.S. Pat. No. 5,538,567, at col. 2, discloses a gas generative propellant mix consisting of from about 55% to about 75% by weight guanidine nitrate; from about 25% to about 45% by weight of an oxidizer selected from potassium and ammonium perchlorates; from about 0.5% to about 5.0% by weight of a flow enhancer, and up to about 5% by weight of a binder. As suitable flow enhancers, graphite and carbon black are mentioned. The only binder taught is calcium resinate.

Aside from the specific composition, the particle size of each component is indicated by the patentee to be important. Thus, the average recommended particle size of GN is said to be between 75 and 350 microns; of the oxidizer, about 50 to about 200 microns; and of the flow enhancer, about 7 to about 70 microns. None of the known prior art discloses or suggests the present invention.

BACKGROUND OF THE INVENTION

The invention of this application is designed to provide a composition for generating a substantially particulate-free, non-toxic, non-flammable, odorless and colorless gas for various purposes, such as the inflation of an air bag in an automotive vehicle. The generation of the desired gas requires the provision of an enclosed pressure chamber having an exit port; a composition comprising a propellant of a guanidine nitrate and/or a gas-generative effective derivative thereof mixed with a perchlorate of an alkali metal. The resulting composition may be made into propellant grains of suitable shape by compaction. The guanidine nitrate compound/$KClO_4$ may be mixed with nitrates of alkali metals or alkaline earth metals as oxidizers and the composition used in an enclosed pressure chamber having an exit port so that upon ignition, the formulation, in response to a sudden deceleration being detected by a sensor device in the pressure chamber, substantially instantly generates a gas. Said gas is then conducted through the exit port of said pressure chamber to accomplish a desired function, such as inflating an automotive vehicle air bag.

SUMMARY OF THE INVENTION

The gas-generating composition of the instant invention contains a propellant which is a mixture composed of about 55% to about 70% of guanidine nitrate or a gas-generative derivative thereof with about 30% by weight to about 45% by weight of an alkali metal perchlorate. The guanidine derivatives may include aminoguanidine nitrate and nitroguanidine as fuels. Alkali metal perchlorates, as well as alkali metal nitrates and alkaline earth metal nitrates, can be used as oxidizers in the present invention. The oxidation ratio is maintained slightly fuel-rich, between 0.92 and 0.98. Said ratio involves the proportion of moles of available oxygen to the moles of oxygen necessary to burn a hydrocarbon to carbon dioxide and water and metals to the metal oxide.

The invention also includes the method of generating a gas by employing the propellant of the present invention, optionally together with suitable other gas generators for the production of non-toxic, non-flammable, odor-free gas. The method is carried out in a conventional air bag inflator.

An important aspect of the instant invention relates to the use of a cellulose acetate butyrate (CAB) as a combustion modifier, providing a ballistic advantage. The physical properties of this cellulose ester (e.g., processing conditions, mechanical and thermal properties) appear in Kirk-Othmer, *Encyclopedia of Chemical Technology*, Third Edition, Volume 5, John Wiley and Sons, New York, page 128 (1979). A principal producer of said ester in the United States is Eastman Chemicals Division of Eastman Kodak Company. For overseas producers, see Kirk-Othmer, same volume, at pp. 137–138.

CAB is utilized in a gas generative composition in about 1 to about 3% by weight, preferably 1% by weight. The inclusion of said cellulose ester compound unexpectedly lowers the pressure that will sustain stable combustion to ambient and insures good reproducibility.

DETAILED DESCRIPTION OF THE INVENTION

Figure 1A:
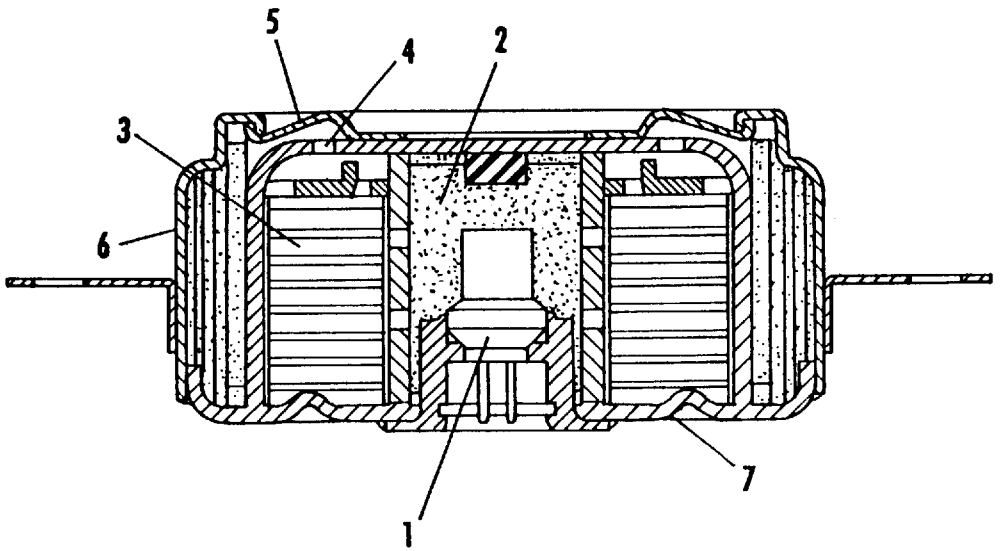
FIGS. 1A and 1B show a conventional passenger side inflator that may be used in practicing the method of the instant invention.
Figure 1B:
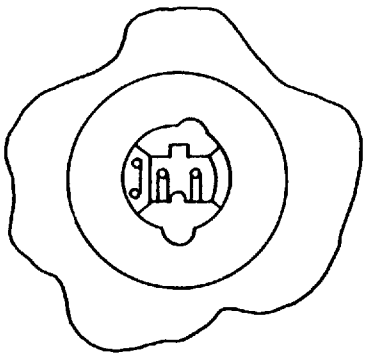

FIG. 1 depicts a conventional driver side inflator for an automobile. In practice, the initiator 1 ignites in response to a sensor (not shown) that senses rapid deceleration indicative of a collision. The initiator gives off hot gas that ignites the ignition charge 2 which causes the main generant charge 3 to combust, generating the inflation gas mixture 4. When the pressure in said gas mixture increases to a certain point, the seal disk 4 ruptures, permitting the gas mixture to exit the manifold 5 through the outlet ports 6 and inflate an air bag. The generant container 7 holds the main generant charge 3.

Figure 2:
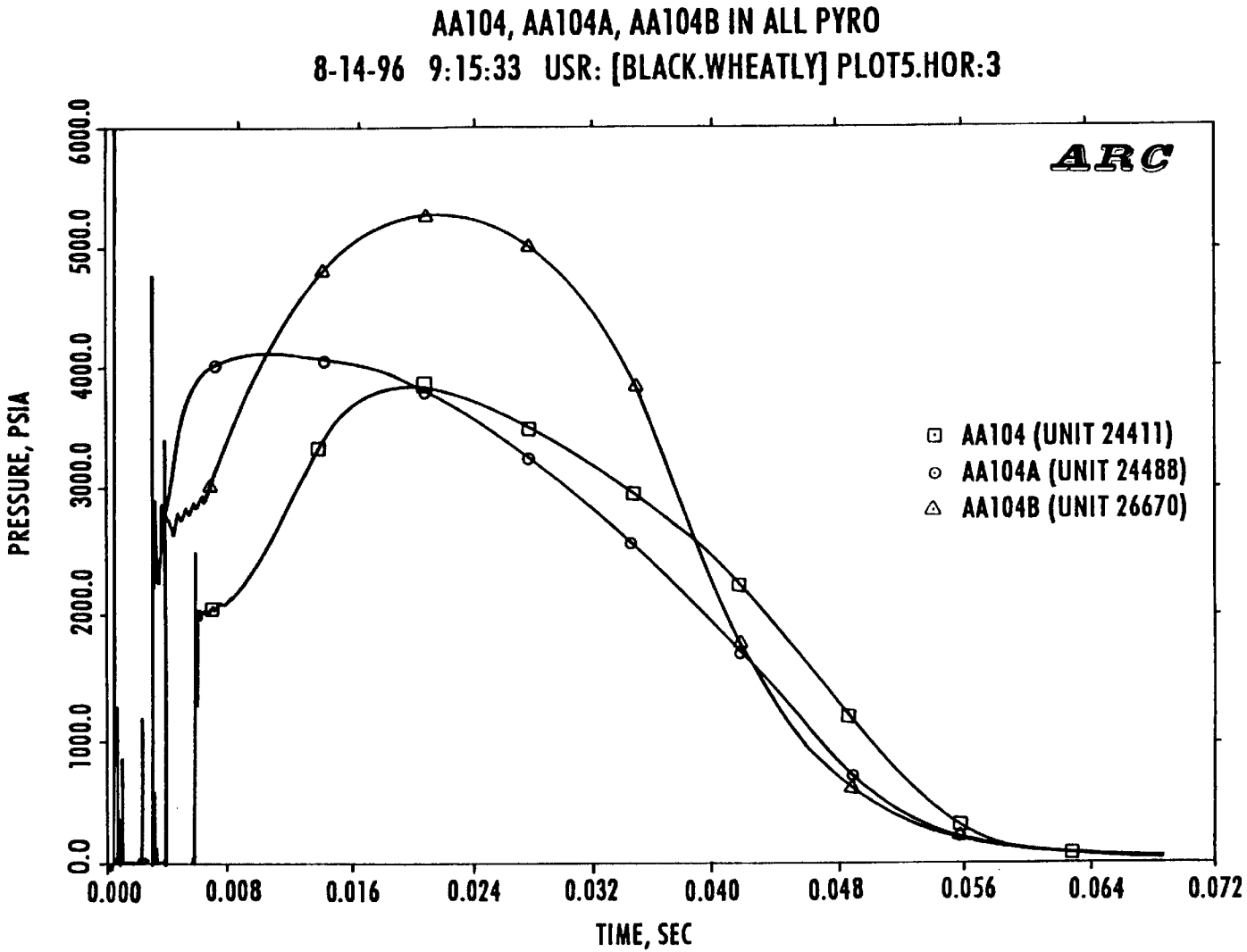
FIG. 2 is a graph showing the pressure (psi) against time (sec) for three compositions, AA104 (GN+KP), AA-104A (GN+KP+1% by wt. CAB) and AA-104B(GN+KP+1% by wt. PVA).

FIG. 2 depicts the effect of CAB on the combustion of AA-104, vis-a-vis an equal amount of PVA and on the composition without either component. The CAB shortens post-ignition dwell time and shortens the time to peak pressure.

Additional objects and advantages of the present invention will become readily apparent to those skilled in this art from the following detailed description wherein only the preferred embodiment of the invention is shown and described, simply by way of illustration of the best mode contemplated for carrying out the invention. As will be realized, the invention is capable of other and different embodiments and its several details are capable of modifications in various obvious respects, all without departing from the invention. Accordingly, the drawing and description are to be regarded as illustrative in nature and not as restrictive.

The present invention involves a composition for generating a substantially particulate-free, non-toxic, non-flammable, odorless and colorless gas, said composition comprising a propellant mixture of about 55 to about 70% by weight of guanidine nitrate (GN) and/or a gas-generative effective derivative thereof, such as aminoguanidinenitrate, nitroguanidine, triaminoguanidine nitrate, etc. with a perchlorate of an alkali metal in an amount of about 30 to about 45% by weight. The composition also comprises a minor amount, as a combustion modifier, of said cellulose acetate butyrate, i.e., about 1 to about 3% by weight of the propellant mixture. In addition to the propellant mixture, the composition may also contain an oxidizer effective amount of a nitrate of an alkali metal or alkaline earth metal.

Exemplary of the propellant compositions are those in which the ratio of GN+CAB:$KClO_4$ is about 55/45, about 65/35 and about 70/30. Other ratios within the indicated range are also expected to provide similar results. In the composition, the oxidation ratio is maintained slightly fuel-rich, the oxidizing compounds being in a ratio of 0.92 to 0.98 to the fuel. The composition preferably contains the propellant in the form of pressed grains of a suitable shape.

The inventive method involves generating a stable substantially particulate-free, non-toxic, non-flammable, odorless and colorless gas comprising the following steps: providing an enclosed pressure chamber having exit ports; disposing within said chamber a gas-generative composition comprising a propellant mixture of about 55 to about 70 percent by weight of GN and/or a gas-generative effective derivative thereof with a perchlorate of an alkali metal or an alkaline earth metal, or a nitrate of an alkaline earth metal, in an amount of about 30 to about 45%. by weight; providing means for igniting said gas-generative composition upon detection by a sensor of the pressure chamber being subjected to a sudden deceleration, whereby gas is substantially instantly generated and conducted through the exit ports of said pressure chamber to inflate, for example, an air bag.

As previously noted, the gas-generative composition includes a minor amount of cellulose acetate butyrate, which functions as a combustion modifier. In the method described above, the gas-generative composition may also include an oxidizing effective amount of a nitrate of an alkali metal or an alkaline earth metal. The oxidation ratio of the components in the gas-generative composition is preferably maintained between about 0.92 and about 0.98. The propellant of the composition is compacted into the form of grains of a suitable shape. When the method is carried out in an automotive vehicle equipped with at least one air bag, the generated gas, conducted through the exit ports, thereafter enters said at least one air bag, which it substantially instantly inflates.

EXAMPLES

The following formulations, encompassed by the composition claims, were employed in conducting the method of this invention:

| Example | GN | $KClO_4$ (KP) | CAB | Oxidation ratio |
|---|---|---|---|---|
| 1 | 67.3 | 31.7 | 1 | .9 |
| 2 | 61.9 | 35.1 | 3 | .9 |
| 3 | 61.3 | 37.7 | 1 | 1 |
| 4 | 55.8 | 41.2 | 3 | 1 |

A particularly preferred composition consists of 64% by weight GN with 35% by weight KP and 1% by weight CAB.

Particle size of the $KClO_4$ may range up to about 25$\mu$. The preferred range is about 15 to about 20$\mu$, with 20$\mu$ being the preferred size. The particle size is important from the standpoint of burn rate. If the particle size is too small, the burn rate may be too rapid, or if too large, the burn rate may be too slow.

PVA & CAB Effects in ARCAIR 104

Pressed pellets for air bag applications sustain thermal and tensile shock during igniter functioning. For ballistic performance to remain unaffected, pellets must be strong enough to remain intact during gas generator functioning. Pellets must retain this capability even after aging (17 days exposure to 107° C.). and cycling (200 cycles −40° to +107° C.). Conservative limits for dimensional stability and final pellet strength after cycling/aging were adopted. For pellets 0.5 inches in diameter, these limits undergo <3%. dimensional change and attain pellet strength greater than 4000 psi at ambient test conditions. The 4,000 psi limit at 25° C. allows a margin for functioning units at hot conditions where pellet strengths begin to decrease. The 3% dimensional change requirement would allow a typical pellet with a diameter of 0.522 inches to increase up to a diameter of 0.538 inches.

TABLE 1

PVA & CAB Effects in ARCAIR 104

| Variable | AA-104 | AA-104A | AA-104B |
|---|---|---|---|
| Additive | — | CAB | PVA |
| Content, % | — | 1 | 1 |
| Pellet Durability, dia./strength | | | |
| Baseline, inches/psi | .522/5046 | .522/4300 | .523/5963 |
| after 200 cycles | .529/5866 | .535.4171 | .527/6469 |
| % change in dimensions | +1.3 | +2.5 | +0.8 |

As indicated in Table 1, addition of 1% CAB to the baseline AA-104 formulation results in inferior dimensional stability and loss of pellet strength due to cycling effects. Addition of 1% PVA, in contrast, produces better dimensional stability and a stronger pellet after cycling relative to the baseline formulation. The PVA results improved when the content was increased from 1 to 2 percent. These results indicate that PVA is functioning as a binder in AA-104 since pellet durability is improved. In contrast, CAB does not perform as a binder since pellet durability is degraded. Since CAB is not functioning as a binder, the formulation containing CAB narrowly passes the screening limits placed on cycling performance tests.

During screening studies, CAB was found to exert surprising influence on the ballistic properties of AA-104. The effects were first noted in ambient-pressure burning tests. The formulation containing CAB was found to sustain combustion at atmospheric pressure whereas AA-104 (no CAB) and AA-104B (with 1% PVA; no CAB) did not. This result was significant since poor combustion at low pressure had been blamed in early tests for long ignition delays and incomplete combustion which left some uncombusted pellet residue after the motor test was complete. In subsequent ballistic studies, CAB was found to shorten the post-ignition dwell time (i.e., time interval between igniter squib actuation and rapid-rise pressurization in the chamber) and shorten the time to peak pressure, both of which are desired traits for quick response time in the pressurization of the gas bottle. These data are described in FIG. 2. A quick rise to peak pressure, as noted in the CAB containing mixes, was attributed to better flame spreading and more complete ignition of the pellet bed. After these formulations were tested over the operational temperature range of −40 to +85° C., it also was found that the AA-104 with 1% CAB exhibited lower $\pi_k$ (temperature sensitivity of motor pressure) relative to both AA-104A and AA-104B. These results are listed in Table 2. A lower temperature sensitivity is desired since it enables lower operating pressures, more reproducible performance across the temperature range, and lighter weight motor cases due to lower peak pressures. Thus, CAB improves the ballistic properties of AA-104 in three areas:

* sustains combustion at ambient pressures
* reduces ignition delay and shortens time to peak pressure in the bottle chamber
* reduces $\pi_k$ over the temperature range of −40 to +85° C.

The value πk $$\pi_k = \frac{\ln(P_1/P_2)}{T_1 - T_2},$$

wherein $P_1$ and $P_2$ are the combustion processor at Tand $T_2$, $T_1$ is 85° C. and $T_2$ is −40° C. By so calculating the $\pi_k$ for each of AA-104, AA-104A and AA-104B, the following results are obtained:

TABLE 2

Ballistic Effects of CAB and PVA in ARCAIR 104

| Variable | AA-104 | AA-104A | AA-104B |
|---|---|---|---|
| Additive Type | — | CAB | PVA |
| Content, % | — | 1 | 1 |
| Ambient Combustion? | No | Yes | No |
| Post ignition dwell (−40° C.), msec | Minor | None | Major |

TABLE 2-continued

Ballistic Effects of CAB and PVA in ARCAIR 104

| Variable | AA-104 | AA-104A | AA-104B |
|---|---|---|---|
| Typical time to peak pressure, msec | 17 | 10 | 30 |
| $\pi_k$ (−40 to +85° C.), %/°C. | 0.56 | 0.28 | 0.38 |

Only the preferred embodiment of the invention and but a few examples of its versatility are shown and described in the present disclosure. It is to be understood that the invention is capable of use in various other combinations and environments and is capable of changes or modifications within the scope of the inventive concept as is expressed herein.

We claim:

1. A composition for generating a low particulate non-toxic, non-flammable, odorless and colorless gas, said composition comprising a propellant mixture of about 55 to about 70% by weight of guanidine nitrate (GN) and/or a gas-generative effective derivative thereof with about 30 to about 45% by weight of a perchlorate of an alkali metal and a minor combustion modifying effective amount of cellulose acetate butyrate (CAB).

2. The composition of claim 1, wherein the CAB is present in an amount in the range of about 1 to about 3% by weight.

3. The composition of claim 2, wherein the CAB is present in an amount of about 1% by weight.

4. The composition of claim 1, wherein the perchlorate is present as potassium perchlorate (KP).

5. The composition of claim 4, wherein GN is present in the amount of about 55.8 to about 67.3% by weight of the propellant composition.

6. The composition of claim 1, further including a nitrate of an alkali metal or an alkaline earth metal in an amount sufficient to function as an oxidizer.

7. The composition of claim 4, wherein KP is present in an amount of about 35% by weight and GN is present in an amount of about 64% by weight.

8. The composition of claim 1, wherein the propellant is in the form of pressed grains of a suitable shape.

9. The composition of claim 1, wherein the fuel is in a slight excess relative to the oxidizer.

10. The composition of claim 9, wherein the oxidation ratio is in the range of about 0.92 to about 0.98.

11. A method for generating a stable low particulate non-toxic, non-flammable, odorless and colorless gas comprising the steps of:

a) providing an enclosed pressure chamber having exit ports;

b) disposing within said chamber a gas-generative composition comprising a propellant mixture of about 55% to about 70% by weight of GN and/or a gas-generative effective derivative thereof with about 30 to about 45% by weight of a perchlorate of an alkali metal and a minor combustion modifying effective amount of CAB; and c) providing means for igniting said gas-generative composition upon detection by a sensor of the pressure chamber being subjected to a sudden deceleration, whereby said gas is substantially instantly generated and conducted through the exit ports of said pressure chamber.

12. The method of claim 11, wherein the CAB is present in a range of about 1% by weight to about 3% by weight.

13. The method of claim 12, wherein the CAB is present in the amount of 1 by weight.

14. The method of claim 11, wherein the perchlorate is present as KP.

15. The method of claim 14, wherein GN is present in the amount of about 55 to about 70% by weight of the propellant composition.

16. The method of claim 11, wherein the gas-generative composition includes an oxidizing effective amount of a nitrate of an alkali metal or an alkaline earth metal.

17. The method of claim 11, wherein the oxidation ratio of the components in the gas-generative composition is maintained slightly fuel-rich, between 0.92 and 0.98.

18. The method of claim 11, wherein the propellant is compacted into the form of grains of a suitable shape.

19. The method of claim 15, wherein the GN is present in said propellant mixture in an amount of about 64% by weight and KP is present in an amount of about 35% by weight.

20. The method of claim 11, carried out in an automotive vehicle equipped with at least one air bag, wherein the generated gas, conducted through the exit ports, thereafter enters said at least one air bag, which it substantially instantly inflates.

21. The composition according to claim 1, wherein the components are in the form of particles and the particle size of the oxidizer is no greater than about 25 $\mu$m.

22. The composition according to claim 21, wherein the particle size of the oxidizer is about 15 to about 20 Mm.

23. The method according to claim 11, wherein the components are in the form of particles and the particle size of the oxidizer is no greater than about 25 $\mu$m.

24. The method according to claim 23, wherein the particle size of the oxidizer is about 15 to about 20 $\mu$m.

* * * * *